US005737951A

United States Patent [19]

Krass

[11] Patent Number: 5,737,951

[45] Date of Patent: Apr. 14, 1998

[54] KEY TURNING DEVICE

[75] Inventor: Adam E. Krass, Hoboken, N.J.

[73] Assignee: Bel-Art Products, Inc., Pequannock, N.J.

[21] Appl. No.: 745,953

[22] Filed: Nov. 8, 1996

[51] Int. Cl.[6] ..... A44B 15/00

[52] U.S. Cl. ..... 70/456 R; 70/408

[58] Field of Search ..... 70/456 R–459, 70/408; D3/207–212; 24/3.6

[56] References Cited

U.S. PATENT DOCUMENTS

| | | | |
|---|---|---|---|
| D. 262,417 | 12/1981 | Kim | D3/207 |
| D. 279,524 | 7/1985 | Enomoto | D3/207 |
| D. 324,610 | 3/1992 | Fox et al. | D3/207 |
| 803,839 | 11/1905 | Merrill | D3/207 X |
| 1,974,558 | 9/1934 | Andis | 70/456 R |
| 2,600,563 | 6/1952 | Michnoff | 24/3.6 |
| 2,790,319 | 4/1957 | Brunner | 70/456 |
| 3,606,777 | 9/1971 | Watson | 70/458 |
| 4,253,321 | 3/1981 | Sorensen | 70/456 R |
| 4,298,999 | 11/1981 | Mackey | 70/456 R X |
| 4,596,126 | 6/1986 | Sorensen | 70/456 R |
| 4,646,913 | 3/1987 | Wing et al. | 70/456 R X |
| 4,910,983 | 3/1990 | Taylor | 70/456 R |
| 5,077,850 | 1/1992 | Brubaker | D3/207 X |
| 5,117,666 | 6/1992 | Keefer | 70/456 R |
| 5,207,082 | 5/1993 | Lemaitre | 70/408 |
| 5,440,910 | 8/1995 | Florian | 70/456 R |
| 5,460,022 | 10/1995 | Parsons | 70/456 R |

FOREIGN PATENT DOCUMENTS

| | | | |
|---|---|---|---|
| 624138 | 7/1927 | France | 70/408 |
| 242402 | 1/1912 | Germany | 70/408 |
| 2089883 | 6/1982 | United Kingdom | 70/408 |

OTHER PUBLICATIONS

Key Holders Publication.

*Primary Examiner*—Suzanne Dino
*Attorney, Agent, or Firm*—Lawrence G. Fridman

[57] ABSTRACT

A device facilitating turning a key in a keyhole of a lock consists of an elongated housing having distal and proximal ends. A receiving, unrestricted opening is formed within a housing and extends between the distal and proximal ends substantially along a longitudinal axis of the housing. At least one key is pivotally arranged at the proximal end of the housing. In operation, the key is transverse to the housing and the key is turned in the keyhole of the lock by a force applied to the housing. An area of application of this turning force is distributed along and restricted by the receiving opening.

19 Claims, 4 Drawing Sheets

KEY TURNING DEVICE

FIELD OF THE INVENTION

This invention relates generally to devices adapted for use by elderly or infirm and, more particularly, it relates to implement-turning devices, for example, to devices facilitating turning of a key in a keyhole of a lock.

BACKGROUND OF THE INVENTION

In view of the difficulty in generating a pincer grip by elderly or infirm, it is quite difficult for those individuals to grip and operate many modern keys having relatively small heads. Handling and turning a small flat key is particularly troublesome to a person whose hands have been disabled by arthritis, multiple sclerosis, muscular dystrophy, cerebral palsy, quadriplegia and other disabilities. Furthermore, many elderly individuals also have limited hand dexterity resulting in difficulty in holding and/or grasping objects. Such limited hand dexterity also leads to reduced ability of such individual to pick up, manipulate and exert force on small objects.

Various types of key-holder and key-turning devices are well known in the art. For example, U.S. Pat. No. 4,910,983 to Taylor provides a key-turning device for assisting a disabled hand to turn a key in an automobile starter switch lock. However, in view of the design of Taylor's housing, a substantial pincer grip is required by the hand of the user to generate a torque sufficient for turning a key within the starter switch lock. Therefore, the underlying concept of Taylor's arrangement cannot be efficiently utilized in the devices adopted for everyday use by the above-discussed category of elderly or infirm. Other key-holding, key-turning devices have either housings requiring substantial gripping force or elaborate key-projecting mechanisms that need considerable agility to operate.

Such prior art devices offer very little to resolve difficulties imposed on the elderly or infirm to facilitate even elementary key turning operations. The solutions offered by the prior art devices are not acceptable for the purposes of this invention and often results in such previously described individuals being rendered dependent upon outside help.

Thus, it has been a long felt and unsolved need for a key-turning device capable of being used by individuals with substantially limited hand dexterity, the key-turning devices enabling a user to turn a key in a keyhole of a lock without a substantial gripping force generated by the fingers of the user and applied to the housing of the device.

SUMMARY OF THE INVENTION

One embodiment of the invention provides a device for facilitating turning of a key in a key-hole of a lock. This device consists of an elongated housing having distal and proximal ends. A receiving, unrestricted opening is formed within the housing and extends between the distal and proximal ends along a longitudinal axis of the housing. At least one key is pivotally arranged at the proximal end of the housing. In operation fingers of a user are inserted into the receiving opening in such a manner that the turning force generated by the fingers is leveraged, distributed along and restricted by the receiving opening. This is accomplished without gripping of the housing by the fingers of the user. The receiving opening is formed by at least inner and outer curved portions spaced from each other and extending along the longitudinal axis of the opening. The inner and outer portions guide fingers of the user during their insertion into the receiving opening and hold the fingers during the key-turning operation. The inner and outer portions extend through the entire thickness of the housing.

According to another aspect of the invention, at least index, middle and ring fingers of one hand of a user are positioned within the receiving opening in such a manner that the palmar surface of these fingers faces the inner portion and the dorsal surface of these fingers faces the outer portion of the receiving opening. These fingers can be also positioned within the receiving opening in a manner that the palmar surface of these fingers faces the outer portion and the dorsal surface of these fingers faces the inner portion of the receiving opening. The inner and outer portions extend symmetrically about the longitudinal axis of the opening.

A further aspect of the invention provides a method of turning a key in a key hole of a lock by means of a device consisting of an elongated housing having distal and proximal ends. A receiving, unrestricted opening is formed within the housing and extends between the distal and proximal ends substantially along the longitudinal axis of the housing. At least one key is pivotally arranged at the proximal end. The method consists of the steps of positioning the key transversely to the longitudinal axis of the housing; inserting fingers of one hand of a user into the receiving opening; and the turning the key by applying the force generated by the fingers in such a manner that such force is leveraged and distributed along and restricted by the receiving opening without gripping the housing by the fingers of the user. The receiving opening is formed by at least inner and outer curved portions spaced from each other and extending symmetrically about the longitudinal axis of the opening and in the steps of inserting and turning, at least the inner and outer portions guide and hold fingers of the user.

Still another aspect of the invention provides the method in which, in the steps of inserting and turning, at least index, middle and ring fingers of one hand of the user are positioned within the receiving opening.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF THE PREFERRED EMBODIMENT

Figure 1:
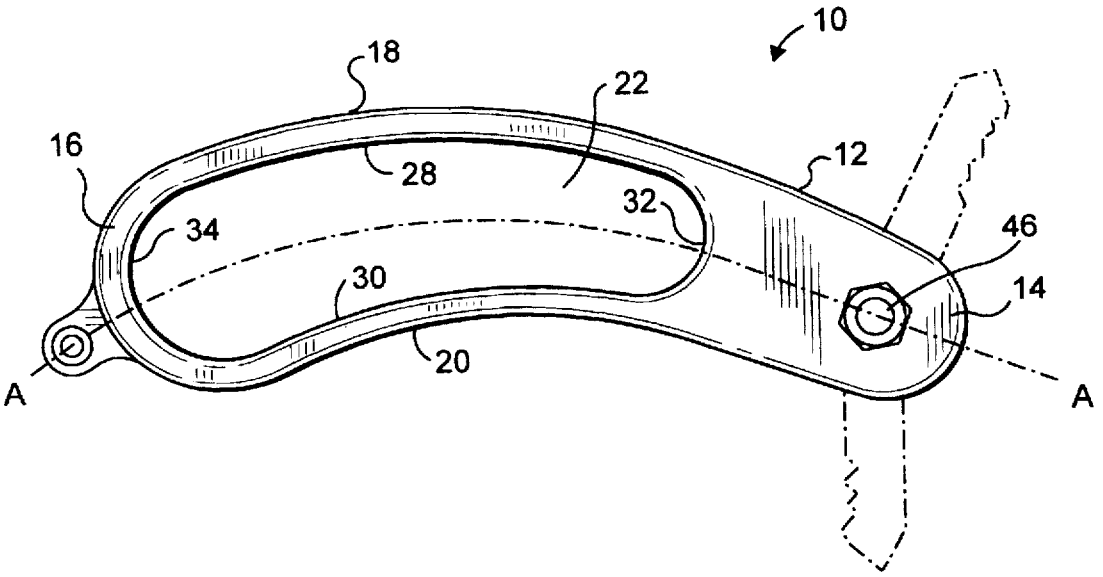
FIG. 1 is a top plan view of a key turning device of the invention.
Figure 2:
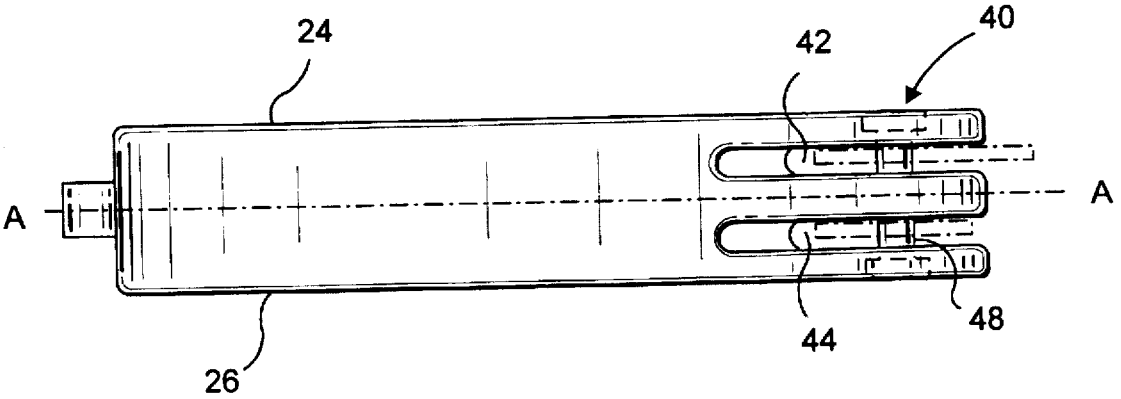
FIG. 2 is a side elevational view thereof.
Figure 3:
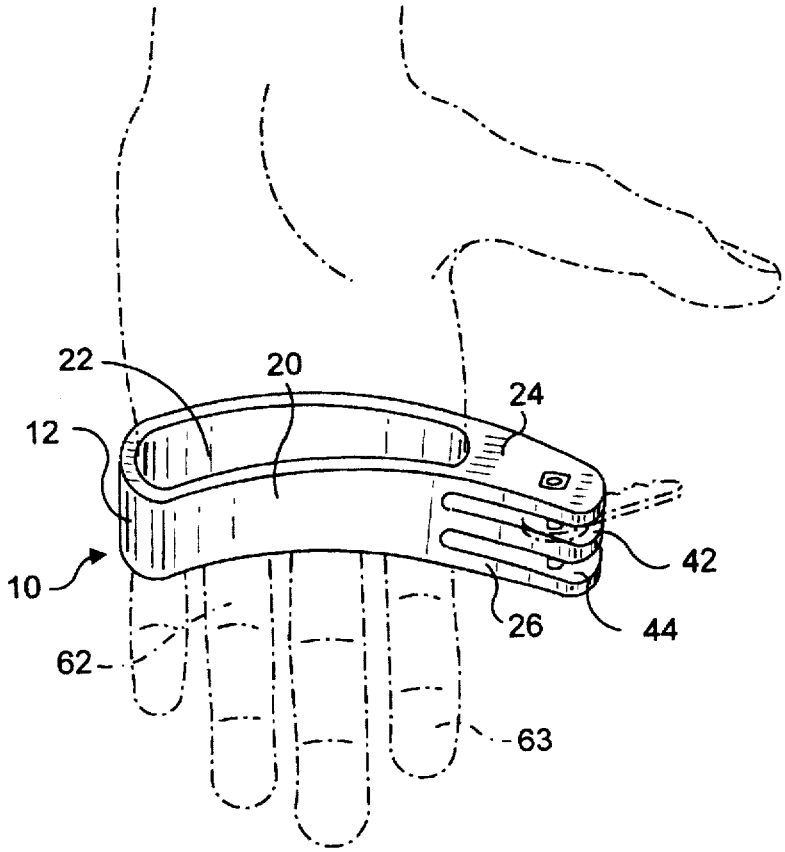
FIG. 3 is a view showing positioning of a hand of a user within the housing.

A key-turning device 10 of the present invention is best illustrated in FIGS. 1–4. An elongated housing 12 of the device is formed by a first outer wall 18, a second outer wall 20, a top wall 24 and a bottom wall 26. The first and second outer walls are joined by a proximal end region 14 and a distal end region 16. A receiving, unrestricted opening 22 is provided within the housing extending between the distal and proximal regions thereof substantially along a longitudinal axis A—A.

It is illustrated in FIG. 1 that the receiving opening 22 can be shifted towards the distal end region 16. However, any suitable positioning of the receiving opening in the housing 12 is within the scope of the invention. Following orientation of the housing 12 illustrated in FIG. 1, the periphery of the receiving opening 22 is defined by spaced from each other slightly convex outer portion 28 and inner portion 30. These portions are interconnected by curved proximal portion 32 and distal portion 34. As will be discussed hereinbelow, to facilitate positioning of fingers, the receiving opening 22 widens in the direction from the proximal to distal portion.

The receiving opening 22 including inner, outer, proximal and distal portions extends through the entire thickness of the housing 12 between the top 24 and bottom 26 walls. In the embodiment of FIGS. 1–4, the top 24 and bottom 26 walls of the housing are substantially parallel to each other, and the planes of at least inner 30 and outer 28 portions of the receiving opening are generally perpendicular to the planes of top and bottom walls. Nevertheless, any other acceptable configuration of the receiving opening is also contemplated.

A key-mounting arrangement 40 is provided at the proximal end 14 of the housing. The key-mounting arrangement consists of at least two slots 42 and 44 extending from the proximal region towards the receiving opening 22. A mounting aperture 46 is formed to receive a mounting fastener 48. This arrangement provides means for adjustably and pivotally securing the key-heads in the receiving slots under adjustable frictional tension. Thus, the keys are individually pivoted under selected degree of frictional tension between a non-operative position, in which the key is maintained in the vicinity of the housing 12 and an operative position, in which the key-bit is pivoted to a position of being transverse to the longitudinal axis A—A of the housing and ready for insertion into a keyhole of a lock. The key-mounting arrangement through the design of the slots exert sufficient pressure on the keys to provide all the friction needed to hold each key in any required pivotal position about the mounting fastener 48. This arrangement makes it possible for an elderly or infirm person to hold a key in a position transverse to the longitudinal axis of the housing and insert the key into the keyhole of a lock.

As can be readily appreciated, during the assembly of the device of the invention, in order to insert keys into the housing, the heads of the keys are inserted into the slots 42 and 44 with the holes in the key heads aligned with the mounting aperture for mounting the fastener. The mounting fastener is then inserted therethrough with all of the keys placed in the slots. The fastener is then tightened until there is sufficient frictional pressure applied to the key-heads to prevent their undesired pivoting. At the same time, the fastener should not be adjusted too tight but just enough to permit the selective pivoting of a key. The adjustment of the tension of frictional resistance is assisted by resiliency of the material of the housing 12. In addition, a key ring aperture is provided at the distal region 16 of the housing. This aperture is adapted to receive a key chain ring, etc.

Figure 5:
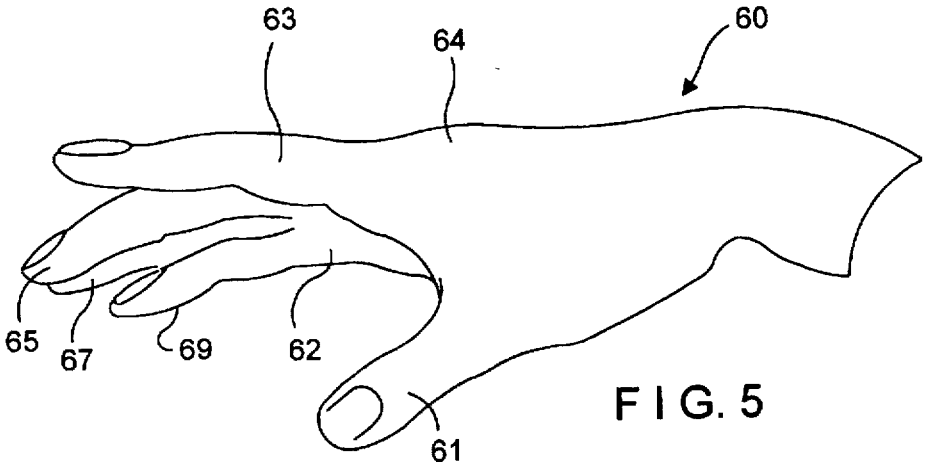
FIG. 5 is a schematic diagram showing a hand of a user.

For the purposes of this application (see FIG. 5), a human hand 60 can be described as consisting of an inner or palmar surface 62 as well as an outer or dorsal surface 64. As represented in FIG. 5, the hand contains thumb 61, index 63, middle 65, ring 67 and little 69 fingers. Each finger includes a proximal area adjacent to the palm, a distal area remote from the palm and an intermediate area interposed between the proximal and distal areas.

In operation of the key-turning device 10 (see FIG. 3), while index, middle, ring and little fingers of one hand of a user are being inserted into the receiving opening, its outer 28, inner 30, proximal 32 and distal 34 portions provide guidance for these fingers. Although many variations in positioning of the fingers are possible, it is preferred that the fingers are inserted into the receiving opening 22 in such a manner that the index finger faces the proximal portion 32.

Upon achieving a working condition of the key-turning device, in one alternative holding arrangement the proximal area of the fingers is situated at the top wall 24 of the housing. In this condition, the palmar surface 62 of the fingers faces the curved inner portion 30 and the dorsal surface of the fingers faces the similarly configurated outer portion (not shown) of the receiving opening 22. The other alternate holding arrangement is for the proximal area of the fingers to be situated at the bottom wall 26 of the housing (see FIG. 3). In this condition, the palmar surface 62 of the fingers faces the curved outer portion 28 and the dorsal surface of the fingers faces the similarly configurated inner portion 30 of the receiving opening 22. Both arrangements provide comfortable engagement between the hand of the user and the receiving opening which is very important for elderly and/or infirm individuals. Furthermore, these arrangements provide secure holding of the housing by the fingers after their insertion into the receiving opening.

Prior to the insertion into the keyhole of the lock, the key is pivoted about the mounting fastener 48 and moved from the non-operative to the operative position. The best result is achieved when the key is positioned at right angle to the longitudinal axis A—A tangential line situated at the mounting aperture 46.

The fingers inserted into the receiving opening 22 are distributed along its longitudinal axis. The housing and the key are then rotated together with respect to the keyhole and exert a necessary force to positively turn the key in the lock. Thus, the forces generated by the fingers and applied to the key through the housing 12 are restricted to the boundaries of the receiving opening 22 and distributed along its longitudinal axis. It is important to realize that in the above-described operation the generated torque enables the user to rotate the key within a keyhole of a lock virtually without gripping of the housing by the fingers. In view of the distance between the key and the receiving opening and the length of this opening, the moment arm is effectively increased leading to reduction of the required magnitude of turning force necessary for rotation of the key in the lock. Furthermore, rotation of the key in the above-described manner provides several times greater leverage as compared to that obtained by using a hand-held ordinary key. Thus, the key-turning device 10 can be efficiently operated by individuals having limited hand dexterity or strength.

Figure 4:
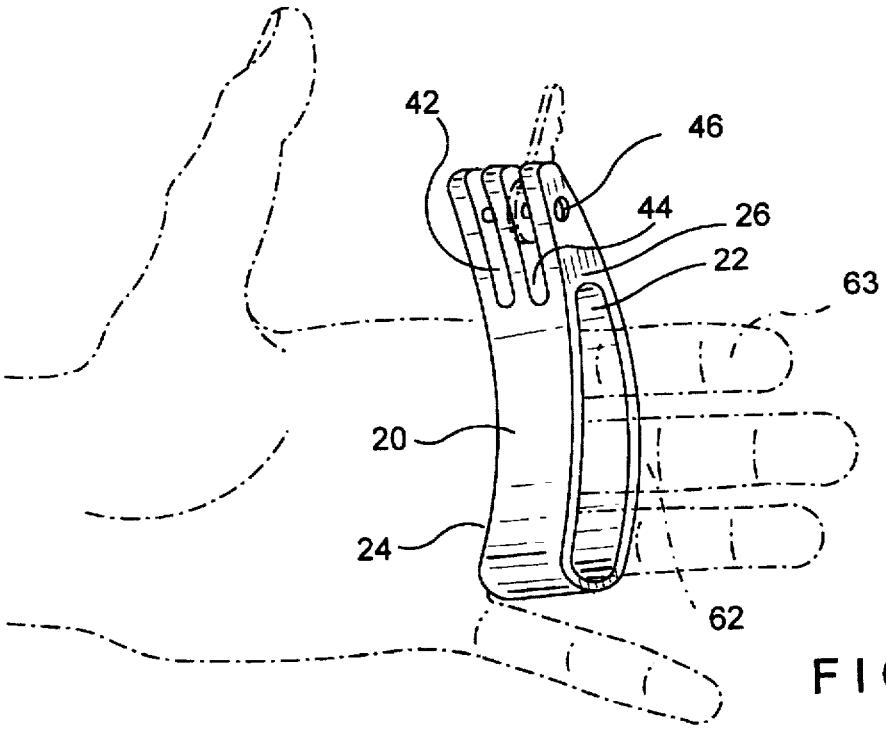
FIG. 4 is a view illustrating alternate positioning of the hand within the housing.

Although the above-discussed embodiment of the invention has been described with reference to utilizing four fingers of the hand of the user to generate the required turning force, it should be understood that other combinations of fingers can be used for the same purpose. For example, as illustrated in FIG. 4, the key turning device can be utilized by positioning of three fingers, such as index, middle and ring in the receiving opening.

Figure 6:
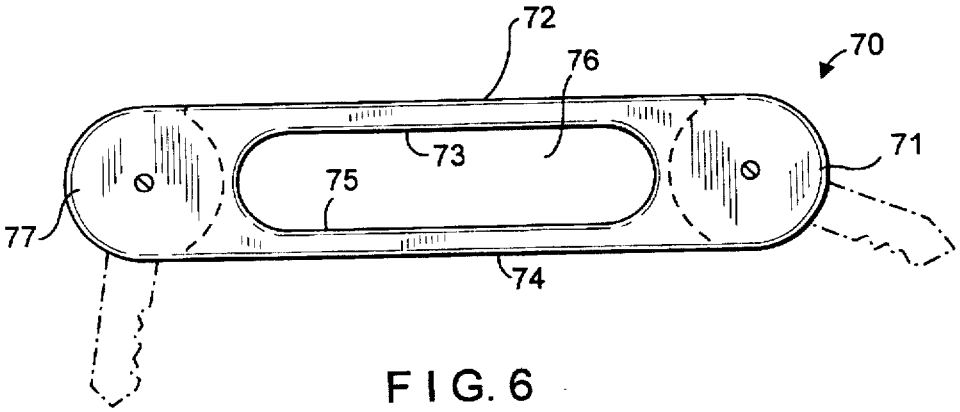
FIG. 6 is a top plan view of another embodiment of the invention.
Figure 7:
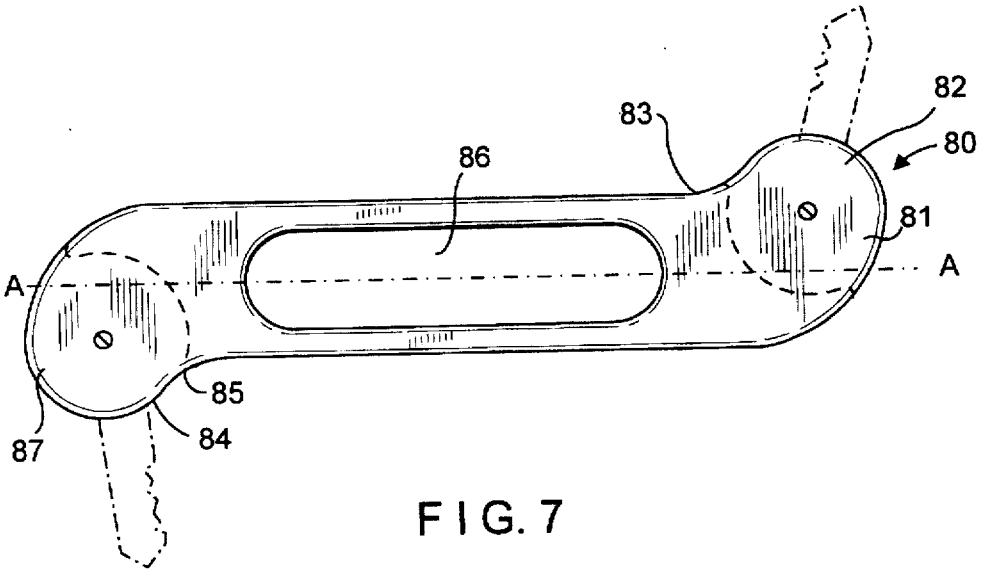
FIG. 7 is a top plan view of a further embodiment of the invention.

A modified form of the housing of the invention is shown in FIGS. 6 and 7. The housing 70 (see FIG. 6) is formed by outer walls 72 and 74 which are substantially parallel to each other. The outer periphery of the receiving opening 76 is defined by substantially straight portions 73 and 75 which are also positioned in parallel relationship. In the embodiment of FIG. 6, key mounting arrangements 71 and 77 are provided at both ends of the housing 70.

In the embodiment of FIG. 7, the housing 80 contains end portions 82 and 84 which extend in opposite directions from the longitudinal axis A—A. The housing 80, similar to the embodiment of FIG. 6, contains two key mounting arrangements 81 and 87 provided at the respective ends thereof 82 and 84. Recessed areas 83 and 85 are defined at the junction of the outer walls of housing 80 with respective end portions. These recessed areas facilitate positioning of the shanks of the keys in the non-operative condition of the device. In many respects, operation of the embodiments of FIGS. 6 and 7 are similar to that described hereinabove.

Figure 8:
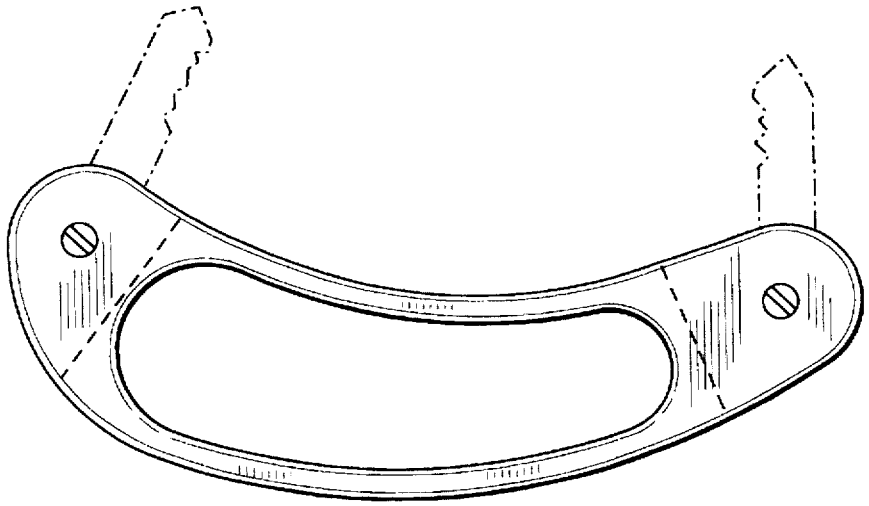
FIG. 8 is a top plan view of still another embodiment of the invention.

The key turning device shown in FIG. 8 utilizes the housing described with respect to FIGS. 1–4 having two key mounting arrangements situated at both ends of the housing.

Figure 9:
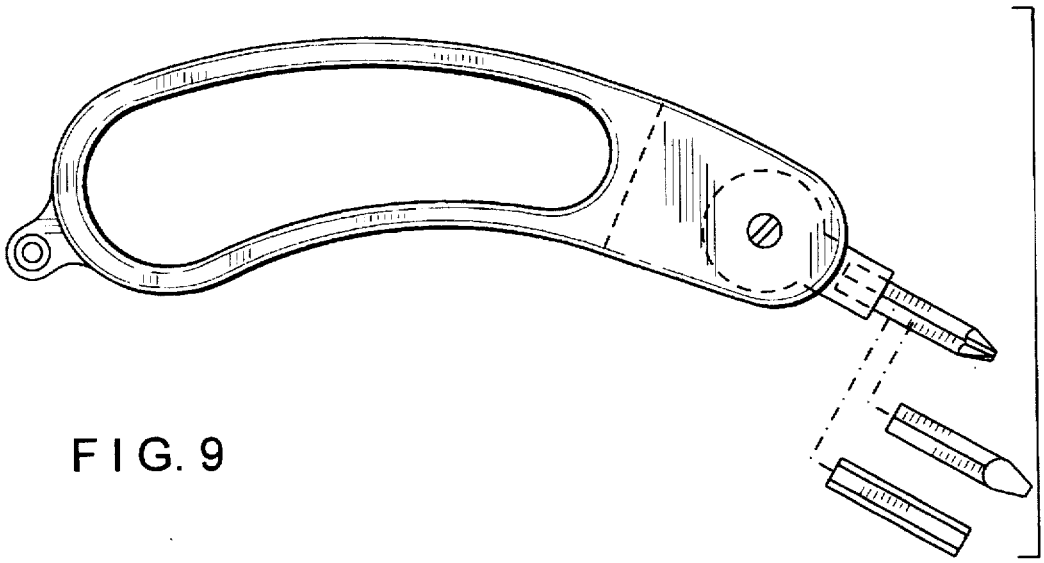
FIG. 9 illustrates use of the housing of invention with other implements.
Figure 10:
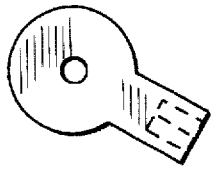
FIG. 10 shows a receiving element usable with the embodiment of FIG. 9.

It will be understood that although a key has been given as an example of an article which can be used in combination with the device according to the present invention, it is equally possible to use the above-described housing arrangement with many implements requiring torque or turning motion for their use or operation. For example, as illustrated in FIG. 9, the housing arrangement of the invention can be used for turning screwdrivers, wrenches, etc. In this respect, FIG. 10 illustrates a receiving member mountable into the slots situated at the proximal region of the housing. The receiving member is pivotable within these slots and adapted to receive screwdrivers, wrenches and other implements.

What is claimed is:

1. A device facilitating turning a key in a keyhole of a lock, comprising:

an elongated housing with distal and proximal ends having length substantially exceeding width thereof, said housing including top and bottom walls and having a longitudinal axis extending substantially along said length between said distal and proximal ends;

at least one keyslot provided at said proximal end, said keyslot adapted to receive a key for movement about a pivotal axis of the housing, a plane of said keyslot being transverse to said pivotal axis;

a receiving unrestricted opening formed within said housing along said longitudinal axis and extending between said top and bottom walls transversely to said plane of said keyslot, whereby in use of said device fingers of a hand of a user are inserted into said receiving unrestricted opening, so that a turning force generated by said fingers is substantially limited by and distributed along said receiving unrestricted opening.

2. The device of claim 1, wherein said turning force is generated without substantial gripping of the housing by the fingers of the user.

3. The device of claim 1, wherein said receiving opening is formed by at least inner and outer portions spaced from each other and extending along a longitudinal axis of the receiving opening, said inner and outer portions guide said fingers of the user during their insertion into the receiving opening and hold said fingers during the key-turning operation.

4. The device of claim 3, wherein said receiving opening further includes distal and proximal portions interconnecting said inner and outer portions, and said inner, outer, distal and proximal portions extend through the entire thickness of the housing.

5. The device of claim 4, wherein in operation of said key-turning device, said distal and proximal portions guide fingers of the user during their insertion into the receiving opening and hold said fingers during the key-turning operation.

6. The device of claim 1, wherein in operation at least index, middle and ring fingers of one hand of the user are positioned within the receiving opening.

7. The device of claim 6, wherein said inner and outer portions are formed having convex configuration, and a palmar surface of said at least index, middle and ring fingers faces the inner portion and a dorsal surface of said fingers faces the outer portion of the receiving opening.

8. The device of claim 6, wherein a palmar surface of said at least index, middle and ring fingers faces the outer portion and a dorsal surface of said fingers faces the inner portion of the receiving opening.

9. The device of claim 3, wherein said inner and outer portions extend substantially symmetrically about the longitudinal axis of the receiving opening.

10. The device of claim 4, wherein said housing is formed with top and bottom walls substantially parallel to each other and planes of said at least inner and outer portions are generally perpendicular to planes of said top and bottom walls.

11. The device of claim 4, wherein said top and bottom walls are substantially parallel to each other, said inner and outer portions of said receiving opening are positioned equidistantly about said longitudinal axis of the housing and extend between said top and bottom walls in a direction generally perpendicular to the plane of said at least one keyslot.

12. A device facilitating turning a key in a keyhole of a lock, comprising:

an elongated housing with distal and proximal ends having length substantially exceeding width thereof, said housing including top and bottom walls and having a longitudinal axis extending substantially along said length between said distal and proximal ends;

at least one keyslot provided at said proximal end, said keyslot being adapted to receive a key for movement about a pivotal axis of the housing, a plane of said keyslot being transverse to said pivotal axis;

a receiving unrestricted opening formed within said housing along said longitudinal axis and extending between said top and bottom walls transversely to said plane of said keyslot, whereby in use of said device an area of application of a turning force is substantially limited by and distributed along said receiving unrestricted opening.

13. A method of turning a key in a keyhole of a lock by means of a device consisting of an elongated housing with distal and proximal ends having length substantially exceeding width thereof, said housing including top and bottom walls and having a longitudinal axis extending substantially along said length between said distal and proximal ends, at least one keyslot provided at said proximal end, said keyslot adapted to receive a key for movement about a pivotal axis of the housing, a plane of said keyslot being transverse to said pivotal axis, a receiving unrestricted opening formed within said housing along said longitudinal axis and extending between said top and bottom walls transversely to said plane of said keyslot; said method comprising the steps of:

pivotably moving a key within the keyslot and positioning the key transversely to the longitudinal axis of the housing;

inserting fingers of one hand of a user into the receiving unrestricted opening; and turning the key within the keyhole of a lock by applying a force generated by the fingers to the housing in such a manner that said turning force is distributed along and restricted by said receiving unrestricted opening.

14. The method of claim 13, wherein said turning force is generated without substantial gripping of said housing by the fingers of the user.

15. The method of claim 13, further including the step of inserting of said at least one key into the keyhole of the lock.

16. The method of claim 13, wherein said receiving opening is formed by at least inner and outer curved portions spaced from each other and extending along the longitudinal axis of the opening, in said steps of inserting and turning, said inner and outer portions guide and hold fingers of the user.

17. The method of claim 16, wherein, in said steps of inserting and turning, at least index, middle and ring fingers of one hand of the user are positioned within the receiving opening.

18. The method of claim 17, wherein in said steps of inserting and turning, a palmar surface of at least the index, middle and ring fingers faces the inner portion and a dorsal surface of said fingers faces the outer portion of the receiving opening.

19. The method of claim 16, wherein in said steps of inserting and turning, a palmar surface of at least the index, middle and ring fingers faces the outer portion and a dorsal surface of said fingers faces the inner portion of the receiving opening.

* * * * *